United States Patent [19]

Derr

[11] 4,097,000

[45] Jun. 27, 1978

[54] SPRAY NOZZLE

[76] Inventors: Bernard A. Derr, 75 Granview Rd., Granville, Ohio 43023

[21] Appl. No.: 739,503

[22] Filed: Nov. 8, 1976

Related U.S. Application Data

[63] Continuation-in-part of Ser. No. 593,198, Jul. 7, 1975, abandoned.

[51] Int. Cl.[2] ..... B05B 1/00

[52] U.S. Cl. ..... 239/599; 239/601

[58] Field of Search ..... 239/599, 601, 595, 597

[56] References Cited

U.S. PATENT DOCUMENTS

| | | | |
|---|---|---|---|
| D. 198,356 | 6/1964 | Charles | 239/601 X |
| 2,647,801 | 8/1953 | Lycan | 239/601 UX |
| 3,556,411 | 1/1971 | Nord et al. | 239/599 X |
| 3,647,147 | 3/1972 | Cook | 239/601 X |

*Primary Examiner*—Joseph F. Peters, Jr.
*Assistant Examiner*—Michael Mar
*Attorney, Agent, or Firm*—Mahoney & Stebens

[57] ABSTRACT

A spray nozzle is provided for producing predetermined spray patterns of fan shaped configuration characterized in having an internal body configuration which is uniquely capable of effecting a very wide angled dispersion pattern of uniform density. The body of this spray nozzle is of disc shape having an outlet or a discharge end-face disposed transversely to a fluid flow axis through the body. An elongated, channel-shaped recess is formed in this discharge end portion and opens outwardly from the end face in transversely oriented relationship to the flow axis. A spray pattern control chamber is formed in the body along the flow axis thereof having an inlet at an end-face opposite the discharge end of the body and an outlet disposed interiorally of the body and in fluid communicating relationship with the channel-shaped recess. This spray pattern control chamber is formed with axially extending sidewall portions that are laterally spaced and are relatively convergent at the outlet end. These sidewalls are interconnected along axially extending edge portions with these edge portions also being relatively convergent at the outlet end and particularly at the point of fluid communication with the channel-shaped recess.

11 Claims, 9 Drawing Figures

SPRAY NOZZLE

This application is a continuation-in-part of my copending application titled "Spray Nozzle", Ser. No. 593,198, filed July 7, 1975, now abandoned.

BACKGROUND OF THE INVENTION

This invention relates to a spray nozzle having a wide application in various industrial field for the application of liquids such as paints and other materials which may be applied as a liquid to surfaces of articles or structures. Nozzles of this invention are also adapted for advantageous use in the agricultural product processing and the chemical fields for the dispensing of fertilizing or weed killing agents that are commonly now utilized in the agricultural field.

An essential and extremely important requirement for nozzles, whether utilized in the application of fluids or liquids in industrial processes or agricultural operatons is that the nozzles be capable of producing an exact and controlled spray pattern to enable precise application of the liquid materials to be thus sprayed. For example, in connection with industrial processes wherein paint is to be applied to the surfaces for machines for article manufacture, it is essential that the spray nozzles be capable of producing a uniform dispersement of the liquid particles over as large an area as is practical for reasons of economy in manufacturing operatons. Spray nozzles heretofore commercially available for such purposes have generally been of a type which are capable of producing a fan shaped spray pattern having an included angle of a maxiumu of 70 - 80°. This angular fan shaped spray pattern is achieved through the combination of nozzle inlet and outlet chambers and orfices which are specifically designed to produce a desired pattern.

SUMMARY OF THE INVENTION

In accordance with this invention a novel spray nozzle is provided which incorporates a unique internal configuration of fluid inlet chambers and outlet orfices which are cooperative in effecting a fan shaped dispersion pattern having an included angle that is substantially greater than heretofore available with the known nozzle constructions and structures that are commercially available. In accordance with this invention the spray nozzle includes a solid body having formed therein a spray pattern control chamber extending axially through the body and terminating at an outlet end. Formed in the body at the exterior or discharge end thereof is an elongated channel shaped recess which is disposed in transversely oriented relationship to the flow access through the body and control chamber. The control chamber of elongated configuration has an oval shaped cross-section thus defining spaced sidewalls that are relatively convergent toward the inner outlet end. These sidewalls are interconnected along adjacent sides by edge portions which are also relatively convergent at the outlet end disposed at the interior of the nozzle body. The inner most end of the channel shaped recess intersects and extends transversely to the long axis of the control chamber and thus forms a fluid outlet orifice with the chamber at its outlet end.

In the preferred embodiment of the spray nozzle, the channel shaped recess is triangularly shaped having the apex thereof at the interior of the body, with this channel also extending completely across the body and open at each end. This configuration of the recess permits the nozzle to readily adapt to the widest possible dispersion angle without interference to the fluid flow therethrough. Appropriate inward converging of the sidewalls and edge portions of the control chamber toward the outlet end thereof disposed interiorally of the nozzle body produces the required configuraton at the juncture of the control chamber with the V-shaped channel recess which results in the advantageous Widenangle dispersion pattern of fan shape. It has been found that the desired or necessary surface configuration of the control chamber sidewalls and edge portions is an inwardly directed curvature in both transverse directions to produce the desired degree of turbulence in the fluid flow pattern as the fluid approaches and enters the outlet adjoining the V-shaped recess in the outer face of the nozzle. It is achievement of the desired degree of turbulence that enables this nozzle to produce the desired wide angle dispersement in the fan shaped spray pattern. These and other objects and advantages of this invention will be readily apparent from the following detailed description of the embodiment thereof and the accompanying illustrative drawings.

DESCRIPTION OF THE DRAWING FIGURES

DETAILED DESCRIPTION OF THE ILLUSTRATED EMBODIMENT

Figure 1:
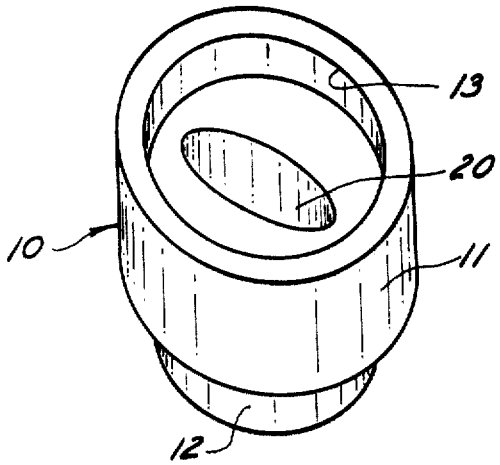
FIG. 1 is a perspective view of a spray nozzle embodied in this invention.

Having reference to the drawings, specifically FIG. 1, there is illustrated a preferred form of spray nozzle 10 which embodies the advantageous constructional features of this invention. This nozzle 10 comprises a cylindrical body 11 having a relatively shorter and axially projecting discharge end portion 12. The upper end of the spray nozzle as seen in FIG. 1 forms the inlet to the nozzle which includes a cylindrical recess 13 formed in the upper end face of the cylindrical body 11.

Figure 5:
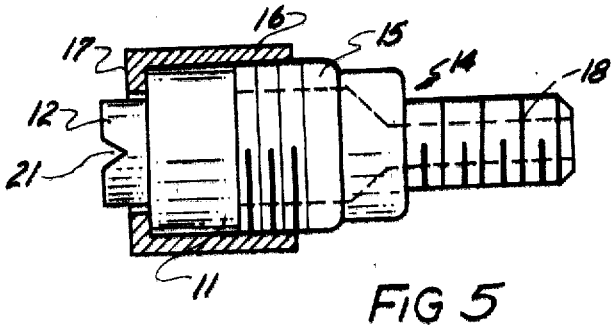
FIG. 5 is a side view of a spray nozzle assembled in an adaptor fitting.

Utilization of the spray nozzle 10 is illustrated in FIG. 5. A spray nozzle constructed in accordance with this invention is shown assembled with an adaptor fitting 14 designed to be interconnected in a fluid supply conduit system (not shown). This adaptor fitting includes a connector head 15 having a threaded outer end portion which interengages with a cap 16. This cap 16 includes an inwardly projecting annular flange 17 which defines a circular aperture of a diameter through which the discharge end portion 12 of the nozzle may project. With the spray nozzle 10 assembled with connector head 15 as shown in FIG. 5, the cap 16 may then be placed over the spray nozzle and threaded onto the connector head to bring the annular flange 17 into engagement with an end surface of the nozzle body 11 and serve to clamp the nozzle against the end of the connector head. A passageway 18 is formed axially through the adaptor fitting 14 to permit fluid flow therethrough and into the spray nozzle 10 for ultimate discharge.

It will be noted here that the illustrated embodiment of the spray nozzle 10 is formed with a relatively smaller diameter discharge end portion 12 which can advantageously project through the aperture formed in the cap 16 of the adaptor fitting. The objective of this particular construction is that the discharge end portion will thus be substantially clear of any of the associated mounting structure of the adaptor fitting and thereby avoid interference with the fluid discharge pattern of the nozzle. This constructional feature is of particular advantage in connecton with the nozzle of this invention which is capable of being formed to produce an extremely wide angle fan shaped spray. Specifically, this nozzle is capable of being formed to produce a fan shaped spray having an included angle in its widest dimension of approximately . Thus it will be seen that having the discharge end portion 12 projecting clear of any obstruction of the adaptor fitting will prevent interference with the spray discharge.

Figure 2:
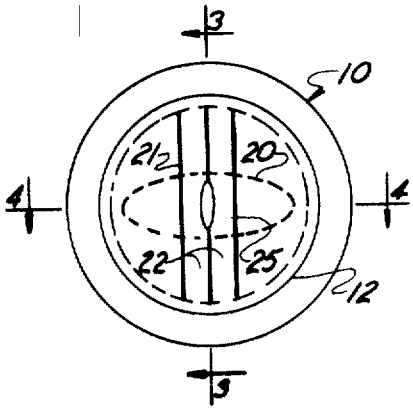
FIG. 2 is a bottom plan view of the spray nozzle shown in FIG. 1.

In accordance with this invention, the advantageous wide angle dispersion pattern and effective control in obtaining a predetermined spray pattern configuration is achieved through a novel configuration and interrelationship of a spray pattern control chamber 20 and clearance channel 21 which are formed in the cylindrical body 11 and discharge end portion 12. As can be best seen in FIGS. 2, 3 and 4, the clearance channel 21 comprises a V-shaped notch formed in the discharge end portion 12 in transversely extending relationship to the longitudinal axis of the spray nozzle and cylindrical body. This channel is oriented with the apex thereof projecting inwardly from the extreme outer face of the discharge end portion with the two sides thus diverging outwardly. For purposes of reference, it will be noted that this channel is essentially oriented with the apex thereof coincident with the central longitudinal axis of the nozzle.

Figure 3:
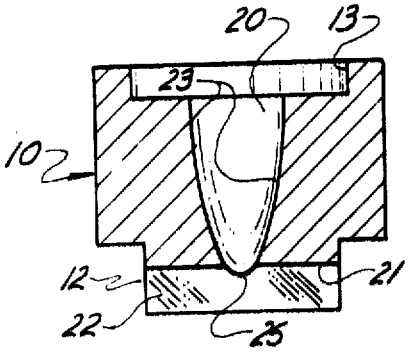
FIG. 3 is a vertical sectional view on an enlarged scale taken along line 3–3 of FIG. 2.
Figure 4:
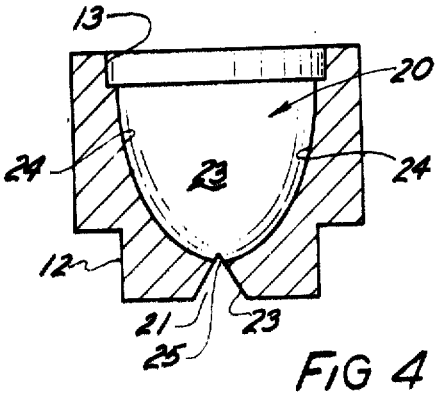
FIG. 4 is a vertical sectional view on an enlarged scale taken along line 4–4 of FIG. 2.

Also formed in the spray nozzle is the spray pattern control chamber 20 which comprises essentially an elongated cavity that is elliptical in cross-section having an upper inlet end that is open at the cylindrical recess 13. The configuration of the chamber can be more accurately defined with respect to the uppermost end which is of an oval cross-sectional shape that is oriented with its major or long axis disposed in perpendicular relationship to a longitudinal axis of the clearance channel 21. The control chamber 20 is also oriented in the cylindrical body 11 to be effectively centered with respect to the longitudinal axis thereof. Each of the sidewalls 23 of the control chamber 20 are relatively convergent at the innermost end of the chamber which is of a depth to extend through the cylindrical body 11 and terminate at a point where the chamber will be intersected by the innermost apex portion of the clearance channel 21. This relative convergence of the sidewalls 23 of the control chamber 20 can be best seen in FIG. 3. Referring to FIG. 4, it will also be noted that interconnecting side portions 24 of the control chamber wall which interconnect the sidewalls 23 are also relatively convergent at the innermost end of the control chamber. The control chamber 20 is thus seen to have an inner end which forms the outlet for fluid flow through the nozzle 10. It is this novel dual inward convergence of the sidewalls 23 and edge portions 24 of the control chamber which is effective in proper configuration to produce the desired wide angle dispersion pattern for the most effective and efficient dispensing of liquids by spray techniques. Referring specifically to FIGS. 3 and 4, it will be seen that the innermost end of the control chamber 20 is intersected by the clearance channel 21 to produce and form an ellipitically shaped discharge orfice 25 through which fluid flows from the control chamber 20 into the clearance channel 21 and ultimately exits from the discharge end of the spray nozzle. Changing the depth of the clearance channel 21 and its degree of intersection with the innermost end of the control chamber 20 will change or alter the specific shape of a particular orfice 25 in accordance with the desired configuration to produce a preferred spray pattern. Alteration of the orfice 25 to obtain the desired shape and size can be effected by both changing the depth of the clearance channel 21 as well as the angular divergence of the sidewalls 23.

Figure 6:
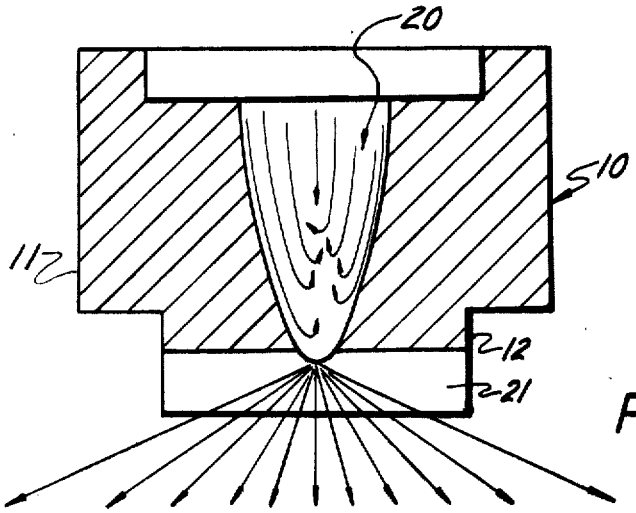
FIGS. 6 and 7 are vertical elevational views similar to respective FIGS. 3 and 4, but illustrating fluid flow through the nozzles.
Figure 7:
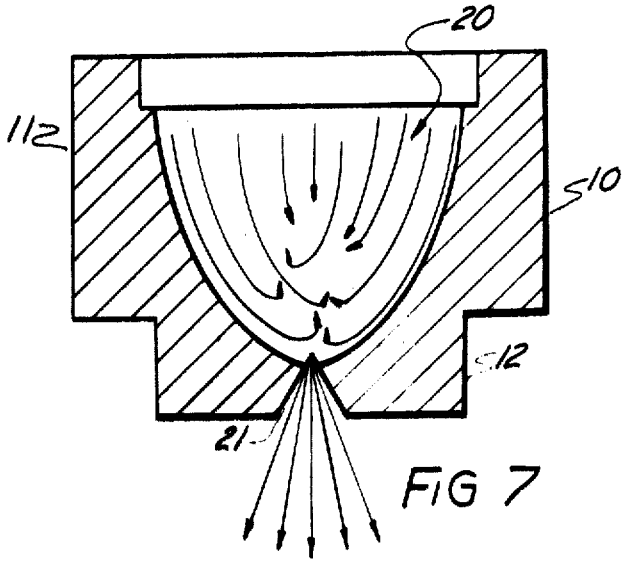

Fluid flow through the spray nozzle is diagramatically illustrated in FIGS. 6 and 7. In these Figures the fluid flow is shown by the several directional flow lines which are to be considered as illustrative and not as specifying a particular flow pattern. The dual inward convergence of the sidewalls 23 and interconnecting edge portions 24 results in a relatively turbulent flow pattern in the region of the discharge orfice 25 of the control chamber 20. It is this turbulence produced by the dual converging sidewalls and edge portions which cooperates to form the desired fan shaped discharge pattern having a relatively large included angle in the largest dimension of the pattern. It is to be understood that a precise flow pattern has not been described with respect to the nozzles thus formed in accordance with this invention and FIGS. 6 and 7 are intended for purposes of diagramatic illustration in facilitating understanding of the concepts of the invention.

Figure 8:
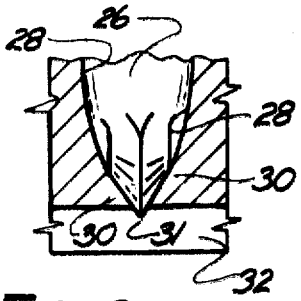
FIGS. 8 and 9 are fragmentary vertical sectional views of modified spray nozzles taken along planes similar to that of line 3–3 of FIG. 2.
Figure 9:
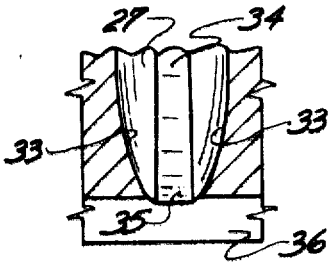

It will also be readily apparent that the specific curvature or convergence of the sidewalls and edge portions of the control chamber may be modified or altered from that shown in FIGS. 2 – 7 to other geometric designs or configurations to produce different specific discharge patterns or to effect different volumetric fluid flow. Two such modified configurations are shown in FIGS. 8 and 9 with these Figures being fragmentary sectional views of spray nozzles similar to that of FIG. 3 but having modified control chamber configurations. Both of the modified control chambers, designated 26 and 27, respectively, are oval in cross-section with the sidewalls being configured substantially as in the previously described embodiment but having the edge portions modified along with portions of the sidewalls closely adjacent the outlet orifice.

With respect to the spray nozzle shown in FIG. 8, the control chamber 26 has sidewalls 28 and edge portions 29 which are formed with planar surfaces 30 in the region closely adjacent the outlet orifice 31 at rhe point of intersection with the clearance channel 32. These planar surfaces enable the control chamber intersection with the clearance channel to be formed to produce a relatively small size outlet orifice 31 which results in a smaller volumetric capacity while maintaining the desired wide angle pattern.

In FIG. 9, the spray control chamber 27 has the sidewalls 33 thereof interconnected by edge portions 34 which are planar although relatively inwardly converging in the region of the outlet orifice 35. This outlet orifice 35 will thus have an elliptical or oval shape but portions of the longitudinal sides of the orifice that are formed on the sidewalls of the clearance channel 36 will be straight. This control chamber configuration is capable of relatively greater volumetric flow and the thickness of the fan shaped dispersion pattern will be increased. While volumetric capacity is increased with this control chamber configuration, the desired wide angle dispersion pattern will be maintained.

While the illustrated embodiment is formed with a clearance channel of V-shaped it will be understood that this configuration is not considered limitative. This channel may be U-shaped or of rectangular cross-section if it is desired to obtain other and different spray discharge configuration. It will also be understood that the angle of the spray in a fan shaped pattern may be adjusted to any desired degree with the novel convergent sidewall and edge portions enabling nozzles to be fabricated with a capability of producing an extremely wide angle of the order of 140°.

It will be readily apparent from the foregoing description of a spray nozzle formed in accordance with this invention has the substantial advantage of being able to form a spray pattern that is fan shaped and have an included angle of the order of 140°. The convergent sidewalls and edge portions interconnecting these sidewalls are effecting this wide dispersion angle. This unique spray nozzle construction including a specifically configured spray control chamber cooperating with a clearance channel in forming an outlet orifice enables the nozzle to be formed to precise dimensional standards to obtain desired flow rates and specific spray patterns.

Having thus described this invention, what is claimed is:

1. A spray nozzle for producing a wide-angle, fan shaped fluid discharge pattern having a body with a longitudinal flow axis, a discharge end portion with an outer end face, and elongated clearance channel formed in said discharge end portion in transversely oriented relationship to said flow axis opening at said outer end face, and a spray pattern control chamber formed in said body along said flow axis and having an inlet end axially spaced from said discharge end portion and an outlet end disposed interiorally of said body and intersecting with said clearance channel thereby defining an outlet orifice, said control chamber being an elongated cavity of generally oval cross-section with a long axis thereof oriented perpendicular to said clearance channel and transversely to said flow axis, said chamber having axially extending sidewalls and edge portions interconnecting said sidewalls and which both converge throughout their length relatively inwardly toward each respective wall or edge portion in the direction of said outlet orifice said edge portions converging at a relatively greater rate than said sidewalls.

2. A spray nozzle according to claim 1 wherein said sidewalls and interconnecting edge portions of said control chamber are arcuately curved in a plane transverse to the flow axis.

3. A spray nozzle according to claim 2 wherein said sidewalls and interconnecting edge portions are arcuately curved in a plane aligned with the flow axis.

4. A spray nozzle according to claim 3 wherein said clearance channel is of a V-shape with an apex thereof intersected by said spray control chamber at its outlet end to form said outlet orifice.

5. A spray nozzle according to claim 4 wherein said outlet orifice is of an elliptical configuration oriented with the long axis thereof aligned with said clearance channel.

6. A spray nozzle according to claim 1 wherein said clearance channel is of a V-shape with an apex thereof intersected by said spray control chamber at its outlet end to form said outlet orifice.

7. A spray nozzle according to claim 1 wherein said clearance channel is formed with planar surfaces.

8. A spray nozzle according to claim 1 wherein the portions of said sidewalls and interconnecting edge portions of said control chamber closely adjacent said outlet orifice are planar.

9. A spray nozzle according to claim 1 wherein said interconnecting edge portions of said spray control chamber are planar in a direction transverse to said sidewalls interconnected thereby.

10. A spray nozzle according to claim 9 wherein said clearance channel intersects said spray control chamber at a point to form an elongated outlet orifice aligned with said clearance channel.

11. A spray nozzle according to claim 1 wherein said clearance channel is formed with relatively divergent walls.

* * * * *